US007681830B2

(12) United States Patent
Tsuruta et al.

(10) Patent No.: US 7,681,830 B2
(45) Date of Patent: Mar. 23, 2010

(54) FILM FEEDING DEVICE AND PACKAGING DEVICE HAVING THE SAME

(75) Inventors: Orihiro Tsuruta, Takasaki (JP); Shunji Yamada, Takasaki (JP); Takayuki Yokoyama, Takasaki (JP)

(73) Assignee: Orihiro Engineering Co., Ltd., Takasaki-shi, Gunma (JP)

( * ) Notice: Subject to any disclaimer, the term of this patent is extended or adjusted under 35 U.S.C. 154(b) by 23 days.

(21) Appl. No.: 12/089,598

(22) PCT Filed: Oct. 19, 2005

(86) PCT No.: PCT/JP2005/019192

§ 371 (c)(1),
(2), (4) Date: Apr. 8, 2008

(87) PCT Pub. No.: WO2007/046136

PCT Pub. Date: Apr. 26, 2007

(65) Prior Publication Data

US 2009/0229229 A1 Sep. 17, 2009

(51) Int. Cl.
*B65H 19/10* (2006.01)

(52) U.S. Cl. ..... 242/554.3; 242/554.4; 242/555.5; 53/551; 53/552

(58) Field of Classification Search ... 242/554.3–554.4, 242/555.5, 556.1, 534, 563; 53/551, 552
See application file for complete search history.

(56) References Cited

U.S. PATENT DOCUMENTS 4,238,261 A * 12/1980 Tetro ..... 156/157
4,543,152 A * 9/1985 Nozaka ..... 156/502
6,096,150 A * 8/2000 Ohno ..... 156/157
6,820,836 B2 * 11/2004 Sato et al. ..... 242/551
2004/0011677 A1 * 1/2004 Arakawa et al. ..... 206/216

(Continued)

FOREIGN PATENT DOCUMENTS

JP 06-298421 10/1994

(Continued)

OTHER PUBLICATIONS

Orihiro Tsuruta, et al., Chinese Office Action dated Nov. 6, 2009, counterpart application by Chinese Patent Application No. 200580051879.1.

*Primary Examiner*—Sang Kim
(74) *Attorney, Agent, or Firm*—Knobbe Martens Olson & Bear, LLP

(57) ABSTRACT

A film feeding device etc. in which, even if film rolls in which tapes are applied to joint between films of the rolls are used, an occurrence of a bag making failure caused by the tape is prevented. A film feeding mechanism (10A) has a receiving member (72) for holding the leading edge of a film (1B) of the standby side and a joining sealer (71) for joining films (1A, 1B). A tape (B) applied to the film (1A) on the use side is detected by a sensor (83), and according to the result of the detection, a cutter (81) cuts of the film (1A) at a portion on the downstream side of the tape. Then, the cut film (1A) and the film (1B) of the standby side are joined by the joining sealer (71), and the two films joined are sent as a long film.

10 Claims, 13 Drawing Sheets

U.S. PATENT DOCUMENTS

2006/0236659 A1* 10/2006 Miyazawa et al. ..... 53/451

FOREIGN PATENT DOCUMENTS

JP 09-058616 3/1997
JP 11-236002 8/1999
JP 2005-145559 6/2005
JP 2005-272125 10/2005
WO WO 2005/037650 A1 9/2004

* cited by examiner

Prior Art

FILM FEEDING DEVICE AND PACKAGING DEVICE HAVING THE SAME

This application is the U.S. National Phase under 35 U.S.C. §371 of International Application PCT/JP2005/019192, filed Oct. 19, 2005. The international Application was published under PCT Article 21(2) in a language other than English.

TECHNICAL FIELD

The present invention relates to a film supplying apparatus and a packaging apparatus for manufacturing a package bag filled with a content. Particularly, the present invention is concerned with a film supplying, apparatus for joining a film from a film roll and a film from another film roll and supplying the two joined films as an elongate film, and a packaging apparatus combined with such a film supplying apparatus.

BACKGROUND ART

Heretofore, there has been known a filling packaging apparatus (hereinafter referred to simply as "packaging apparatus") for continuously producing packaged products (package bags) filled with a content such as a liquid, a viscous substance, or the like, for example. Generally, the packaging apparatus manufactures package bags by folding a film in the form of an elongate sheet reeled out from a film roll, into a tubular form, and feeding the content into the film and forming sealed regions on the film.

FIG. 1 shows a film reeled out from a film roll. As shown in FIG. 1A, end marks A are normally applied in advance to a terminal end portion of the film wound on the film roll for indicating the end of the film. End marks A are regions where aluminum foil tapes or vinyl tapes are applied, for example. The packaging apparatus uses an optical sensor or the like for detecting these marks to stop the packaging operation. The film also has, in addition to end marks A, a plurality of registration marks C disposed at a given pitch which is established depending on the size (lengthwise dimension) of package bags to be manufactured.

Actually, the film wound on film roll R comprises a plurality of joined films of a predetermined length. As shown in FIG. 1B, the films are joined to each other by tape B' across seam joint B. Tape B' itself is not thermally sealable. If an attempt is made to thermally seal table B', then the tape will be melted, causing problems.

JP11-236002A discloses a packaging apparatus which does not thermally seal seam joint B between tapes. The disclosed packaging apparatus will be briefly described below with reference to FIG. 2.

As shown in FIG. 2, the packaging apparatus disclosed in JP11-236002A is of a general structure which comprises folding guide 114 for folding a film into two plies, vertical sealing mechanism 130 for forming vertical seal F1 on the folded sheet, feeding nozzle 15 for feeding a content into the film, horizontal sealing mechanism 150 for forming horizontal seals F2 on the folded sheet at portions which will serve as bottom and top regions of a package bag, and cutting mechanism 160 for cutting horizontal seals F2 to sever the package bag from the film. These mechanisms are actuated at given timings in timed relation to the feeding of the film to successively manufacture package bags filled with the content.

The packaging apparatus is mainly characterized in that it further includes seam joint detecting means 16 for detecting seam joints B, and the actuation of the above mechanisms is controlled based on the detected result from seam joint detecting means 16 to prevent tapes B' at seam joints B from being thermally sealed. Therefore, the problems (e.g., a portion of the melted tape is applied to a seal bar of the horizontal sealing mechanism to lower the quality of package bags which will subsequently be manufactured) caused by the melted tape are prevented from arising.

Another known packaging apparatus of this type joins the terminal end of a film from a film roll and the beginning end of a next film roll to each other at the time the first-mentioned film roll is finished up, so that a film can continuously be supplied (see JP9-58616A).

DISCLOSURE OF THE INVENTION

Problems to be Solved by the Invention

As described above, when package bags are continuously manufactured using a film with tapes B applied thereto at different positions, it is important not to thermally seal tapes B. The packaging apparatus disclosed in JP11-236002A controls the actuation of vertical sealing mechanism 130 and horizontal sealing mechanism 150 in various fashions based on detected results from detecting means 116, for thereby preventing tapes B from being thermally sealed. However, tapes B applied to the film nevertheless pass through vertical sealing mechanism 130 and horizontal sealing mechanism 150. Therefore, if sealing mechanisms 130, 150 are actuated out of step with synchronized timing, then they may possibly catch tape B. The packaging apparatus disclosed in JP11-236002A still remains to be improved in this respect.

The present invention has been made in view of the above difficulties. It is an object of the present invention to provide a film supplying apparatus and a packaging apparatus which are capable of reliably preventing a failure from arising due to tapes while manufacturing a bag, even when a film roll of films with the tapes being applied across seam joints between the films is used.

Means for Solving the Problems

To achieve the above object, there is provided in accordance with the present invention a film supplying apparatus for holding two film rolls, joining the end of a first film reeled out from one of the film rolls and the end of a second film reeled out from the other film roll to each other, and supplying the two joined films as an elongate film, comprising film holding means holding the beginning end of the first or second film in a standby state, film joining means disposed near the film holding means, for joining the films to each other in a joining position, film feeding means for drawing at least one of the first and second films in use from the film roll, tape detecting means for detecting a tape applied to a seam joint between the first and second films, and cutting means for cutting off a portion of the film in use which is disposed upstream of a joined region thereof, in a cutting position which is disposed downstream of the tape detecting means with respect to the direction in which the film is fed, wherein the cutting means cuts off a portion of the film in use which is disposed downstream of the tape, based on a detected result from the tape detecting means, and the film joining means joins the cut end of the film in use and the end of the first or second film held in the standby state, to each other.

With the film supplying apparatus thus constructed according to the present invention, the tape applied to the seam joint between the films is detected by the tape detecting means, and the portion of the film which is disposed downstream of the tape is cut off by the cutting means. Therefore, the tape is not included in the joined elongate film. Therefore, when a packaging mechanism produces package bags from the elongate film, it does not catch the tape.

In the above invention, the film feeding means should preferably feed the film in use until the cut end of the film in use moves close to the joining position, and thereafter the film joining device should preferably join the films to each other. Therefore, any overlapping film portion is reduced and hence any film waste is minimized.

More specifically, the above film supplying apparatus according to the present invention may comprise a rotary support supporting two roll holding members on which the film rolls are rotatably mounted, the rotary support being rotatable about a support shaft to positionally reverse the film rolls through 180°, two guide roller groups disposed on a circumferential surface of the rotary support extending around a center coaxial with the support shaft, one for guiding the first film and the other for guiding the second film, wherein the rotary support is selectively movable between a first in-use posture in which the first film is a film in use and the second film is a standby film and a second in-use posture which is reversed 180° from the first in-use posture and in which the first film is a standby film and the second film is a film in use.

Preferably, the above film supplying apparatus according to the present invention further comprises a movable guide roller disposed between the tape detecting means and the cutting means and movable to a predetermined position for increasing the length of the film extending from the tape detecting means to the cutting means. Accordingly, even when package bags of a relatively large size are produced, the film supply mechanism is prevented from being large in size, and the tape is prevented from being included in the elongate film.

If films with registration marks applied thereto are used, then the film supplying apparatus should preferably have registration mark detecting means for detecting the registration marks, wherein the film feeding means stops feeding the film in use after the tape detecting means detects the mark and the registration mark detecting means detects the first registration mark which is disposed downstream of the tape, and thereafter feeds the film in use again over a predetermined distance after the cutting means cuts the film in use, for thereby positionally aligning the registration marks on the film in use and the registration marks on the other standby film with each other.

The above film supplying means may be combined with any of the various types of packaging mechanisms that provide a packaging apparatus. According to an example, the packaging mechanism may shape the elongate film supplied from the film supplying apparatus into a tubular form, vertically seal the tubular form into a tubular film with a vertical sealing mechanism, horizontally seal the tubular film with a horizontal sealing mechanism to produce a tubular film having a bottom, feed a content into the tubular film, and thereafter horizontally seal the tubular film again with the horizontal sealing mechanism to produce a package bag filled with the content.

Advantages of the Invention

According to the present invention, as described above, since no tape is included in the elongate film made of two films joined to each other, a failure is reliably prevented from arising due to tapes while manufacturing a bag.

BRIEF DESCRIPTION OF THE DRAWINGS

FIG. 15 is a perspective view showing another structural example of a sensor for detecting a tape or the like.

DESCRIPTION OF REFERENCE CHARACTERS

Figure 1A:
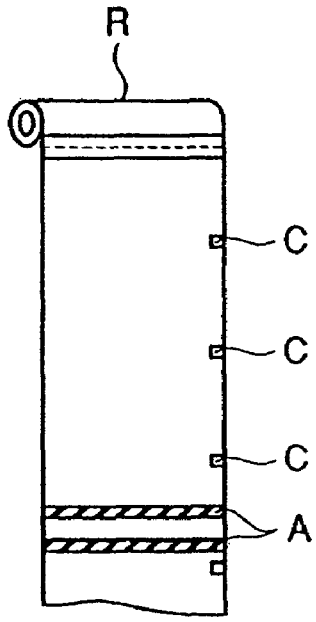
FIG. 1A is a view showing a film reeled out from a film roll.

1A, 1B film
1' tubular film
2 unfilled space
3 thermally sealed portion
10 packaging apparatus
10A film supply mechanism
10C packaging mechanism
14 folding guide
15 feeding nozzle
30 horizontal sealing mechanism
31 heater bar
41 feed roller
45 squeezing roller
60 horizontal sealing mechanism
61 heater bar
62 heater bar bearing member
70 joining mechanism
71 joining sealer
73 clamp
74 holding member
75 support shaft
76, 77 roll holding member
81 cutter

82 cutter bearing member
84 support shaft
83 sensor
85 roller for reeling out film
86, 87 guide roller
88 rotary support
89 distance adjusting device
89*a* guide roller
89*b* cylinder arm
91 package bag
F1 vertically sealed region
F2 horizontally sealed region
Ra, Rb film roll

BEST MODE FOR CARRYING OUT THE INVENTION

Exemplary embodiments of the present invention will be described below with reference to the drawings.

1st Exemplary Embodiment

Figure 3:
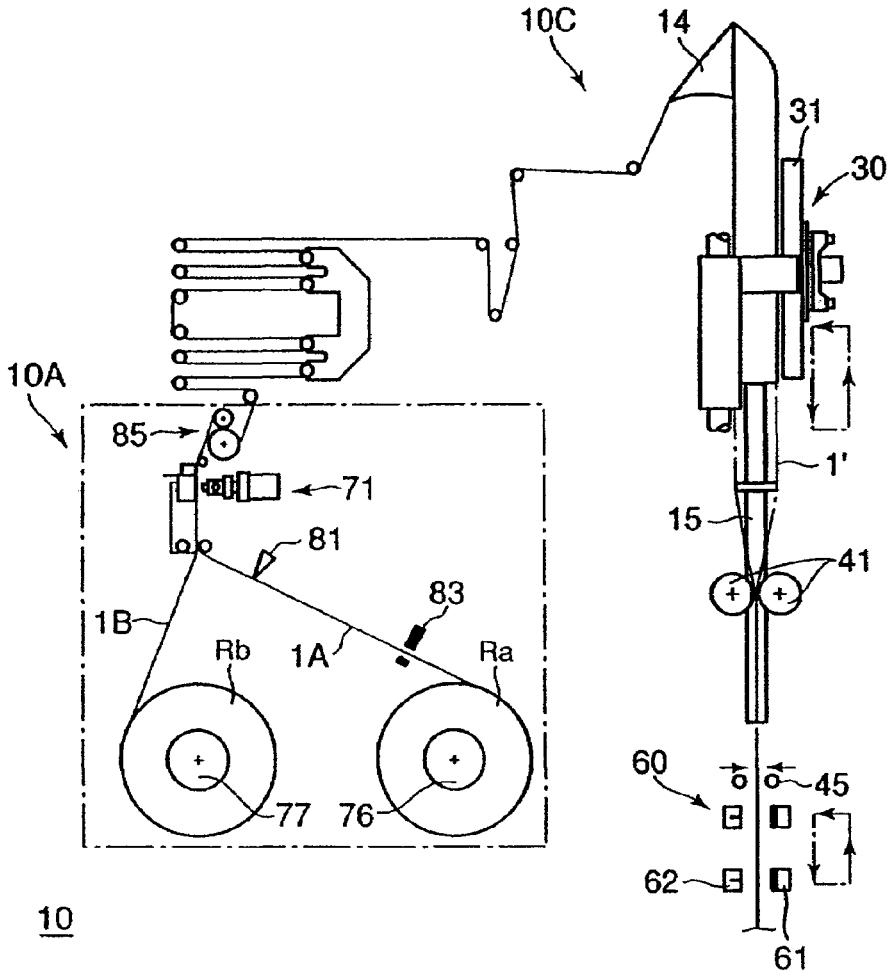
FIG. 3 is a schematic view showing an arrangement of a packaging apparatus according to an exemplary embodiment of the present invention.

FIG. 3 is a schematic view showing a basic arrangement of a packaging apparatus according to an exemplary embodiment of the present invention.

As shown in FIG. 3, packaging apparatus 10 according to the present exemplary embodiment generally comprises film supply mechanism 10A for reeling out films from film rolls Ra, Rb and joining film 1A and film 1B to each other when required, and packaging mechanism 10C for shaping the films reeled out from film supply mechanism 10A into a tubular form and forming vertically sealed regions and horizontally sealed regions in the films to manufacture package bags continuously.

Figure 4:
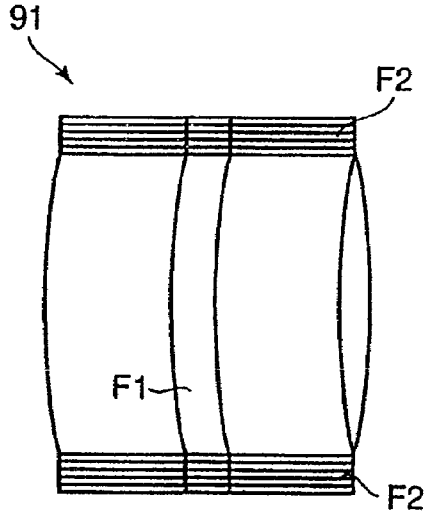
FIG. 4 is a view showing a package bag manufactured by the packaging apparatus shown in FIG. 3.

Package bags manufactured by packaging apparatus 10 are not limited to any types. For example, as shown in FIG. 4, a manufactured package bag may be pillow-type package bag 91 having two horizontally sealed regions F2 and vertically sealed region F1 serving as a back lining. Package bag 91 is filled with a content such as a liquid, a viscous substance, or the like.

The present invention is mainly characterized as the structure of film supply mechanism 10A. But first, the manufacture of package bag 91 with entire packaging apparatus 10 will be described below. In FIG. 3, film supply mechanism 10A is schematically shown, and specific structural details thereof will be described later on with reference to other figures.

Film supply mechanism 10A comprises two roll holding members 76, 77 on which respective film rolls Ra, Rb are removably mounted, joining sealer 71 for joining the end of film 1A to the beginning end of film 1B that follows film 1A, and rollers 85 for reeling out the films from the film rolls. Film joining mechanism 10A also has sensors 83 (tape detecting means) for detecting tapes B applied to seam joints of films and cutter 81 for cutting off the film. Film joining mechanism 10A thus constructed joins a film and another film to each other at a predetermined timing and supplies the joined films as an elongate film to packaging mechanism 10C.

Packaging mechanism 10C comprises folding guide 14 for folding the film into a tubular form, vertical sealing mechanism 30 for vertically sealing side edges of the film folded by folding guide 14 to form vertically sealed region F1 thereby producing tubular film 1', and a pair of feed rollers 45, a pair of squeezing rollers 45, and horizontal sealing mechanism 60 which are disposed downstream of vertical sealing mechanism 30 with respect to the direction in which the film is fed.

Packaging mechanism 10C is of a structure identical to a vertical filling packaging machine disclosed in JP-A 2004-276930 filed earlier by the present applicant. Each of vertical sealing mechanism 30 and horizontal sealing mechanism 60 performs a thermally sealing process called "box motion" to manufacture package bags while continuously feeding the film without stopping it.

Vertical sealing mechanism 30 includes heater bar 31 with a built-in heating means such as a heater or the like. Heater bar 31 is movable toward and away from the film, and is also reciprocally movable vertically (in the direction in which the film is fed).

Tubular film 1' is fed in a substantially circular cross-sectional shape, or stated otherwise, with a space kept therein, until it passes through vertical sealing mechanism 30. Thereafter, tubular film 1' is pressed to a flat shape by a guide plate (not shown) disposed between vertical sealing mechanism 30 and feed rollers 41.

Feed rollers 41 are disposed in sandwiching relation to the transverse ends of pressed tubular film 1'. Feed rollers 41 serves as film feed means in packaging mechanism 10C, and rotate to feed tubular film 1' downwardly.

The pair of squeezing roller 45 grips the tubular film in a manner to divide the content which is fed into the tubular film from feeding nozzle 15. While thus gripping the tubular film, the pair of squeezing roller 45 rotates to feed the tubular film downwardly with an unfilled space free of the content that is being formed in the tubular film.

Horizontal sealing mechanism 60 comprises heater bar 61 with a built-in heating means such as a heater or the like, and heater bar bearing member 62 disposed in confronting relation to heater bar 61. These paired members sandwich tubular film 1' and heat the film to form horizontal sealing regions F2 (see FIG. 4) in the film. Heater bar 61 and heater bar bearing member 62 also make box motion as with vertical sealing mechanism 30. In other words, heater bar 61 and heater bar bearing member 62 move downwardly in synchronism with the feeding of the film while sandwiching tubular film 1'.

Although not shown, heater bar 61 has a built-in cutter for cutting horizontal sealing regions F2 to sever the package bag from tubular film 1'. Heater bar bearing member 62 has a corresponding clearance groove for preventing the cutter as it projects from interfering with heater bar bearing member 62.

Figure 5:
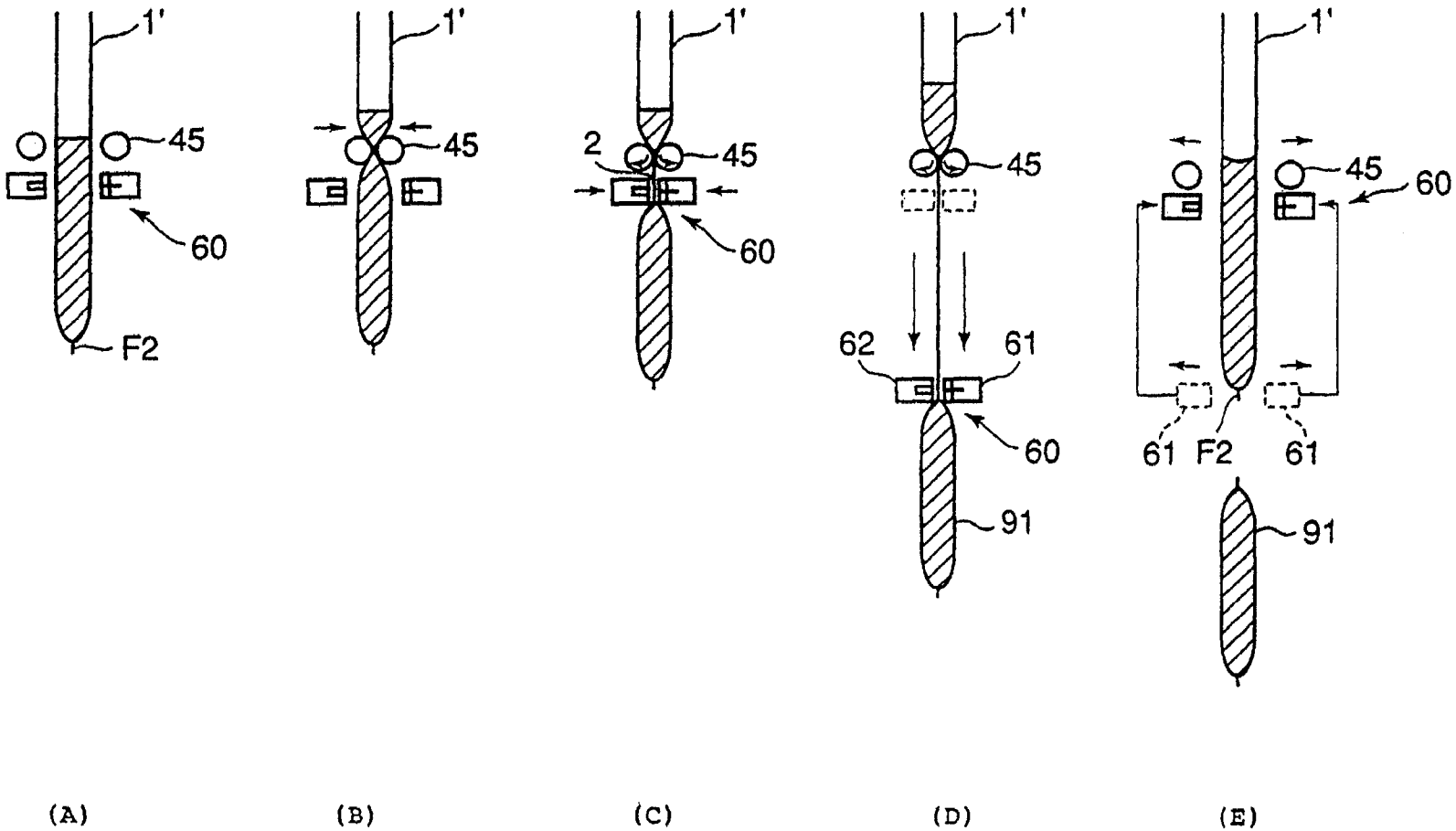
FIGS. 5A through 5E are views showing an example of a process of manufacturing package bags with the packaging mechanism shown in FIG. 3.

A packaging process of packaging mechanism 10C thus constructed will be briefly described below with reference to FIG. 5.

In FIG. 5A, horizontally sealed region F2 formed in a previous packaging process is disposed at the lower end of tubular film 1', so that a bottom is formed in tubular film 1'. Tubular film 1' is filled with a content whose liquid level is positioned just beyond squeezing rollers 45.

Then, as shown in FIG. 5B, the pair of squeezing rollers 45 grips the portion of tubular film 1' in which the content is present, thereby dividing the content into upper and lower contents.

Then, as shown in FIG. 5C, squeezing rollers 45 are rotated to deliver tubular film 1' downwardly with content-free unfilled space 2 formed therein. After the tubular film is delivered to a position in which unfilled space 2 is sandwiched by horizontal sealing mechanism 60, horizontal sealing mechanism 60 sandwiches unfilled space 2.

Thereafter, as shown in FIG. 5D, while heater bar 61 and heater bar bearing member 62 are sandwiching unfilled space 2, squeezing rollers 45 are continuously rotated, and horizontal sealing mechanism 60 is moved downwardly in synchronism with the feeding of the film. While tubular film 1' is being sandwiched by heater bar 61 and heater bar bearing member 62, tubular film 1' is heated to form horizontally sealed region F2. After heater bar 61 and heater bar bearing member 62 move to the lowermost end, the built-in cutter of heater bar 61 is projected to sever the package bag.

Then, as shown in FIG. 5E, the tubular film is released from heater bar 61 and heater bar bearing member 62 and also from the pair of squeezing rollers 45. Now, one package bag 91 filled with the content is obtained. In tubular film 1', the content that has been stored above squeezing rollers 45 falls downwardly. Thereafter, heater bar 61 and heater bar bearing member 62 move to their original positions, bringing packaging mechanism 10C back to the initial state shown in FIG. 5A. Packaging mechanism 10C repeats the above packaging operation to continuously manufacture package bags.

Figure 6:
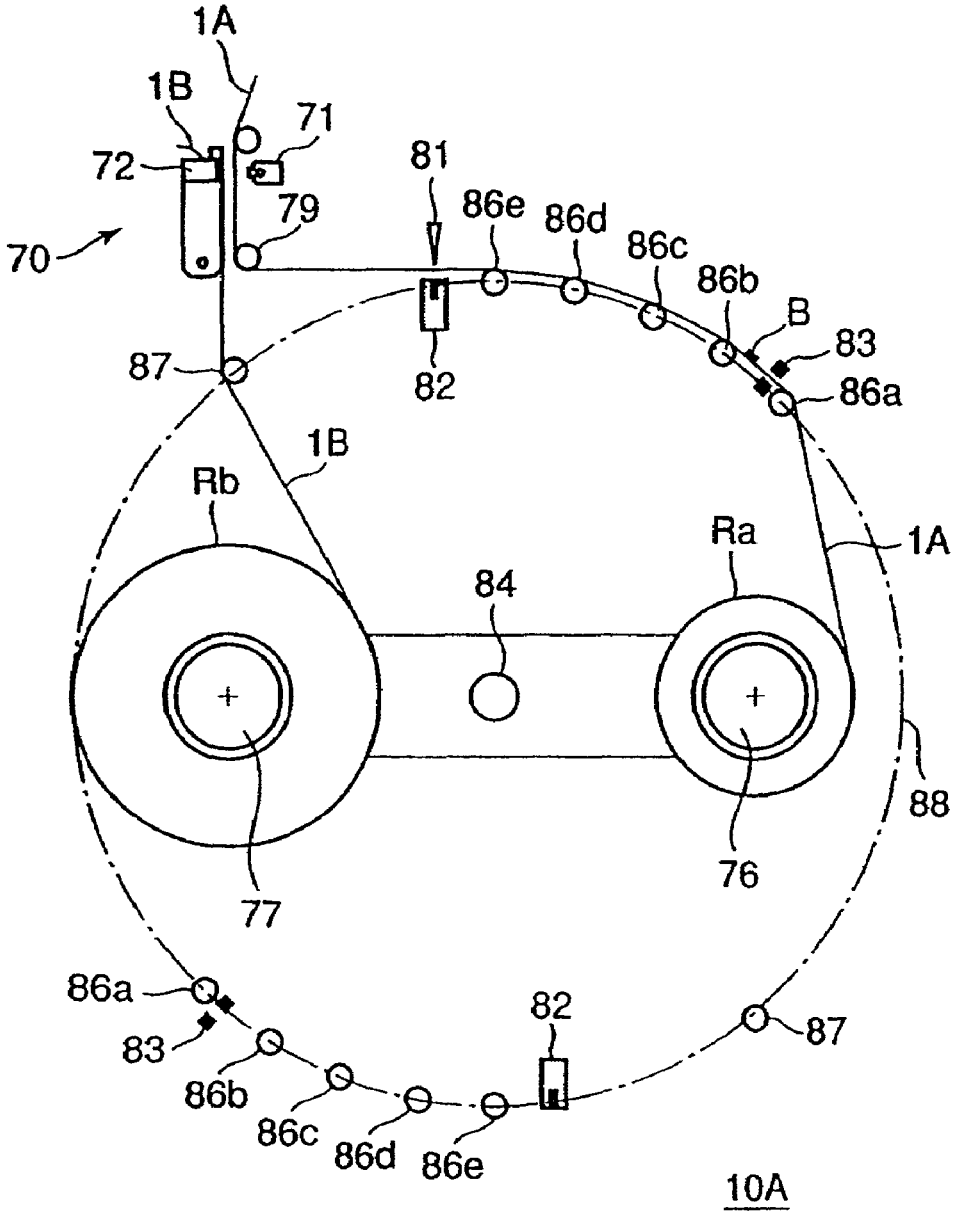
FIG. 6 is a front elevational view showing specific structural details of a film supply mechanism used in the packaging apparatus shown in FIG. 3.
Figure 7:
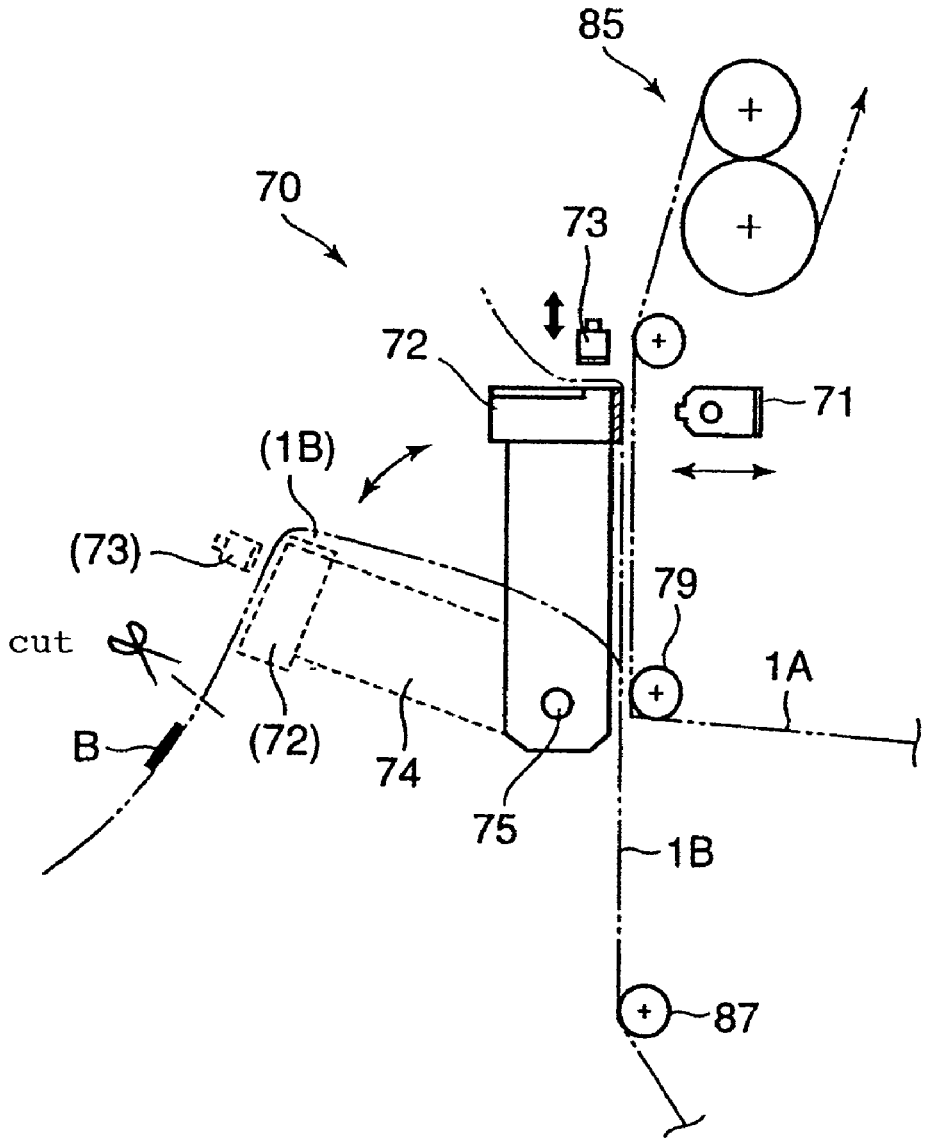
FIG. 7 is an enlarged view showing a structure of a joining mechanism of the film supply mechanism and nearby components.

Specific structural details of film supply mechanism 10A according to the present exemplary embodiment will be described below with reference to FIGS. 6 and 7. In FIGS. 6 and 7, the film in use is designated by 1A, and the standby film by 1B.

Film supply mechanism 10A has joining mechanism 70 including joining sealer 71 and provided as a structural assembly for joining the films to each other. Joining sealer 71 has a built-in heating means such as a heater or the like. Joining sealer 71 cooperates with bearing member 72 in sandwiching two films 1A, 1B to thermally seal and join the films to each other. Joining sealer 71 is moved toward and away from bearing member 72 by a drive source such as an air cylinder, for example.

As shown in FIG. 7, clamp 73 is disposed above an upper surface of bearing member 72 for movement toward and away from the upper surface thereof. Clamp 73 and bearing member 72 jointly grip the end of film 1B, holding film 1B in a standby state.

Figure 8:
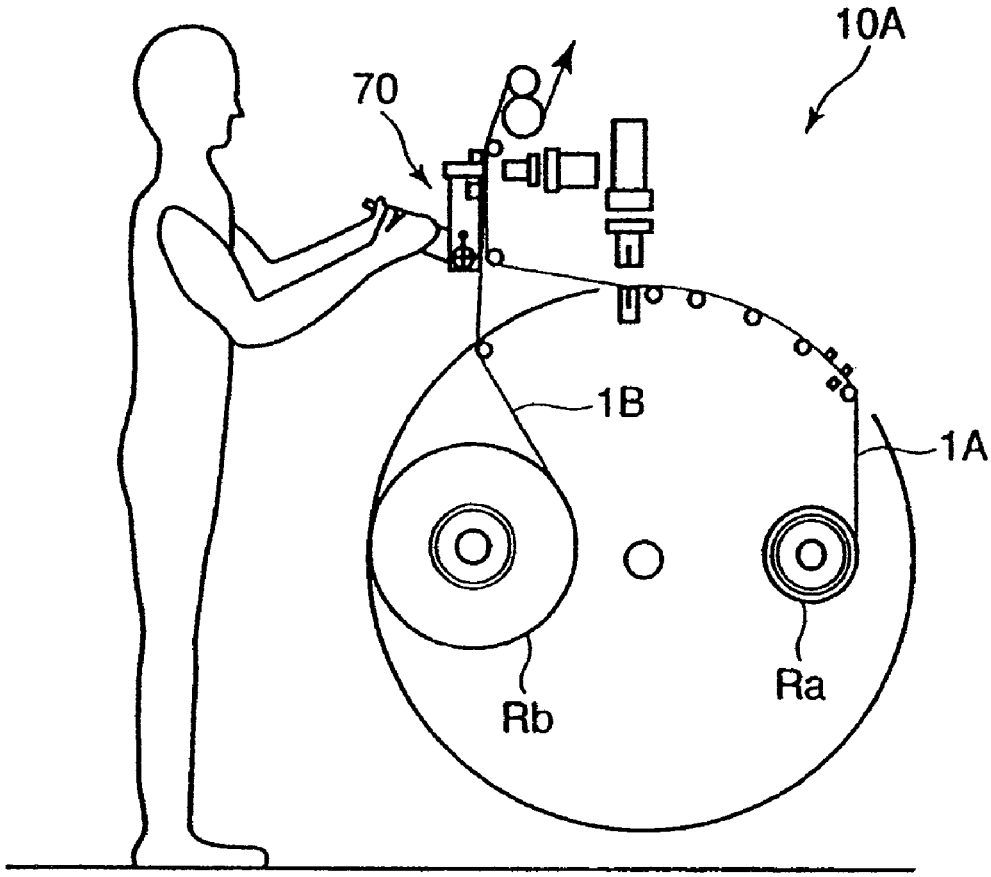
FIG. 8 is a view illustrative of the manner in which a standby film is set in the film supply mechanism.

Film 1B is manually set on clamp 73 as shown in FIG. 8 as described in detail later with respect to operation of supply mechanism 10A. To allow film 1B to be manually set easily on clamp 73, bearing member 72 and clamp 73 are held by holding member 74 (see FIG. 7) that is angularly movable through a predetermined angle about support shaft 75. For setting film 1B in position, the end of film 1B can thus easily be pulled out through the gap between roller 79 and support shaft 75. The drawn end of film 1B is threaded through the gap between clamp 73 and bearing member 72, and clamp 73 is moved to grip film 1B. Then, holding member 74 is returned to its original position. The process of setting film 1B in position is now completed. At the time when the thermally sealing process of joining sealer 71 is finished, clamp 73 is automatically spaced from bearing member 72, releasing film 1B.

Figure 9:
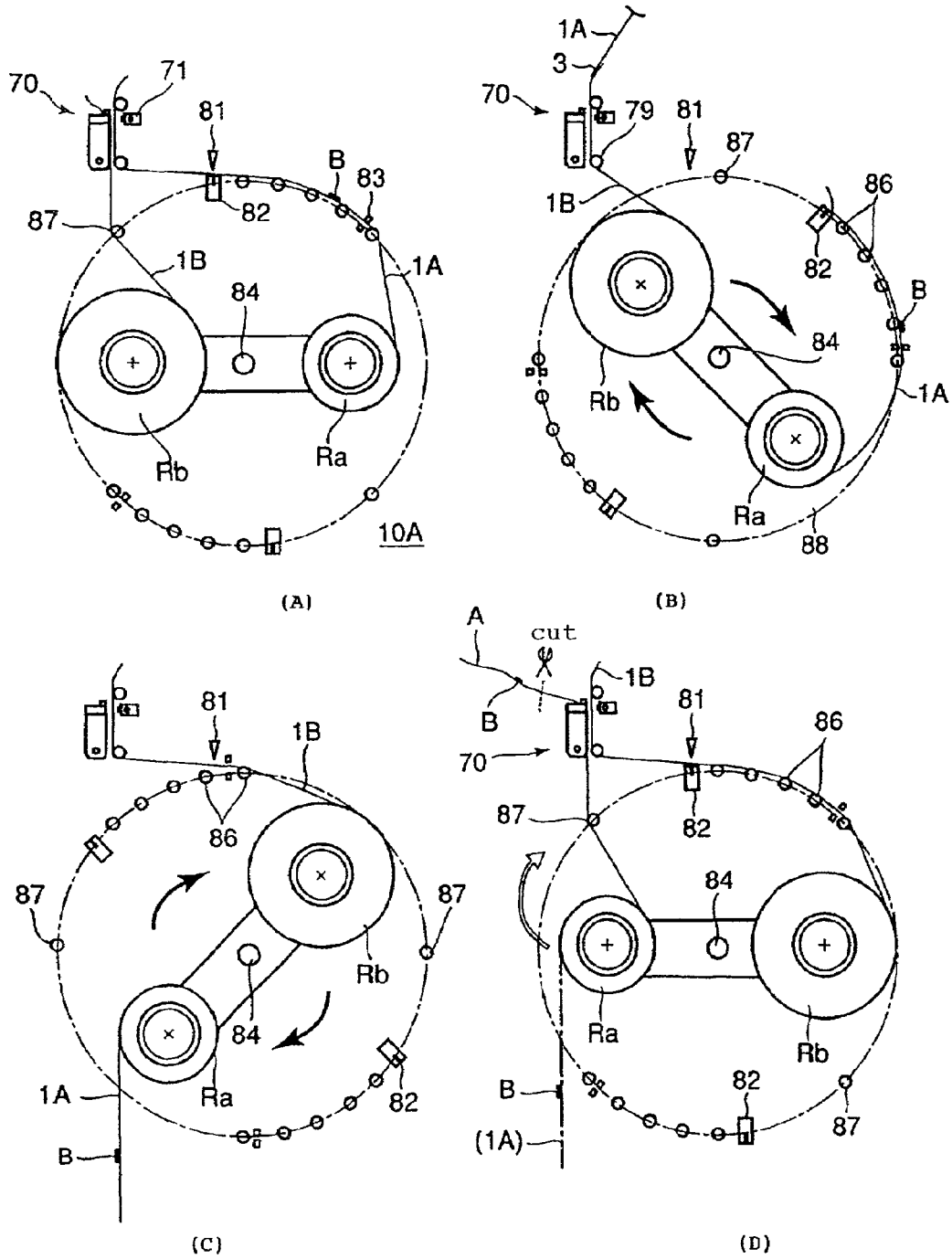
FIGS. 9A through 9D are views illustrative of the manner in which the film supply mechanism shown in FIG. 6 operates.

Referring back to FIG. 6, film supply mechanism 10A has two roll holding members 76, 77 holding respective film rolls Ra, Rb. Two roll holding members 76, 77 are mounted on rotary support 88. Rotary support 88 is rotatable clockwise, as shown, about support shaft 84 (see FIG. 9). Film roll Ra and film roll Rb are thus positionally reversed through 180° as shown in FIGS. 9A and 9D. The 180° angular movement is performed after film 1A and other film 1B are joined to each other. The reason for the angular movement will be described later with respect to the overall operation of film supply mechanism 10A.

Since film rolls Ra, Rb are also used in a reversed state, the positions of film rolls Ra, Rb and the positions of sensors 83, etc. to be described below are basically symmetrical 180° around support shaft 84.

As shown in FIG. 6, a plurality of guide rollers 86*a* through 86*e* for guiding film 1A reeled out from film roll 1A are mounted on the outer circumferential surface of rotary support 88. Guide rollers 86*a* through 86*e* are disposed at equal intervals on the circumferential line (indicated by the dot-and-dash line) extending around a center coaxial with support shaft 84. Each of guide rollers 86*a* through 86*e* is rotatable. Guide roller 86*e* is positioned above support shaft 84. Film 1A is trained around and extends substantially horizontally between guide roller 86*e* and roller 79 near joining mechanism 70.

Sensor 83 for detecting tape B on the film is disposed between guide rollers 86*a*, 86*b*. Sensor 83 is not limited to any type insofar as it can detect tape B, and may comprise an optical sensor or the like. Though at least one sensor 83 may be provided, two or more sensors 83 may be provided for detecting tape B with higher reliability.

Cutter bearing member 82 is disposed slightly leftward of guide roller 86*e* along the circumferential surface, and has a groove defined in an upper surface thereof for allowing the cutting edge of cutter 81 to enter therein. Guide roller 87 different from the above guide roller group is disposed leftward of cutter bearing member 82 along the circumferential surface. Guide roller 87 serves to guide the standby film (film 1B in FIG. 6). Guide roller 87 is positioned substantially directly below bearing member 72 to hold the standby film vertically between guide roller 87 and bearing member 72. Film B thus vertically held and film B guided by roller 79 extend parallel to each other, with a predetermined clearance defined between the films.

The above group of components (sensor 83, cutter bearing member 82, and guide rollers 86, 87) is associated with film roll Ra. A similar group of components is disposed in a 180°-reversed position in association with other film roll Rb. These groups of components are positionally rotatable about support shaft 84 upon rotation of rotary support 88.

Figure 10:
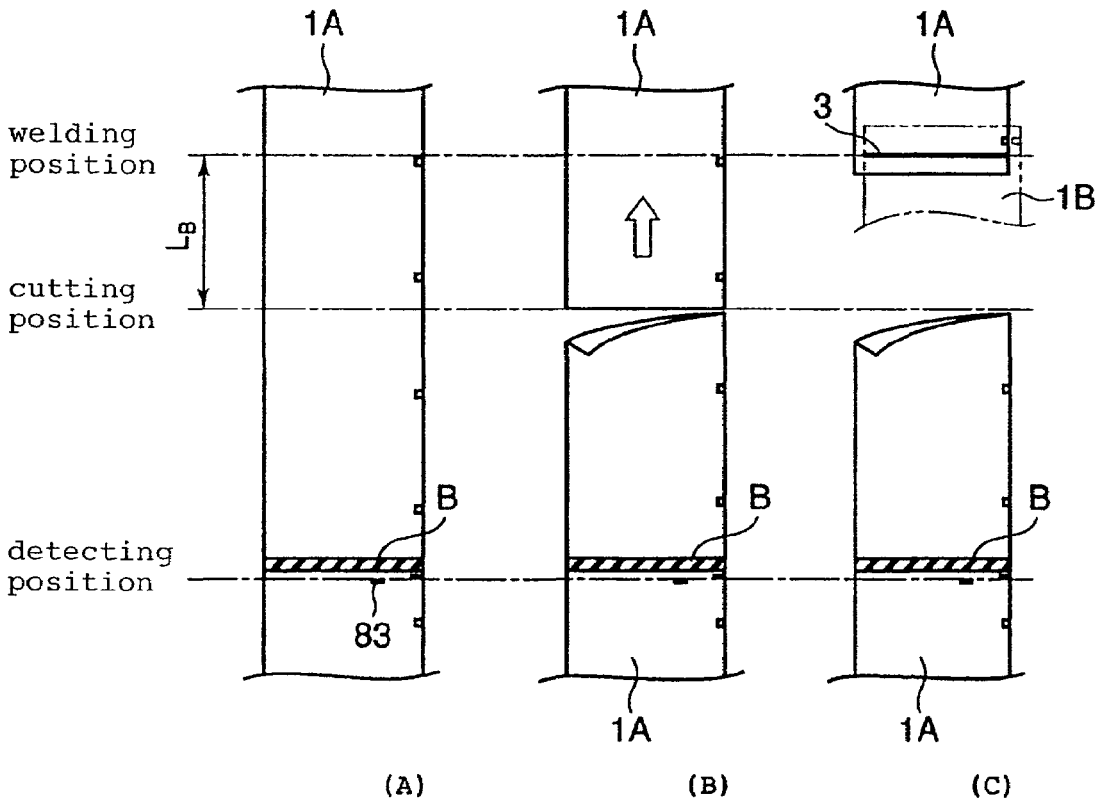
FIGS. 10A through 10C are views illustrative of the manner in which the film supply mechanism shown in FIG. 6 operates.
Figure 11:
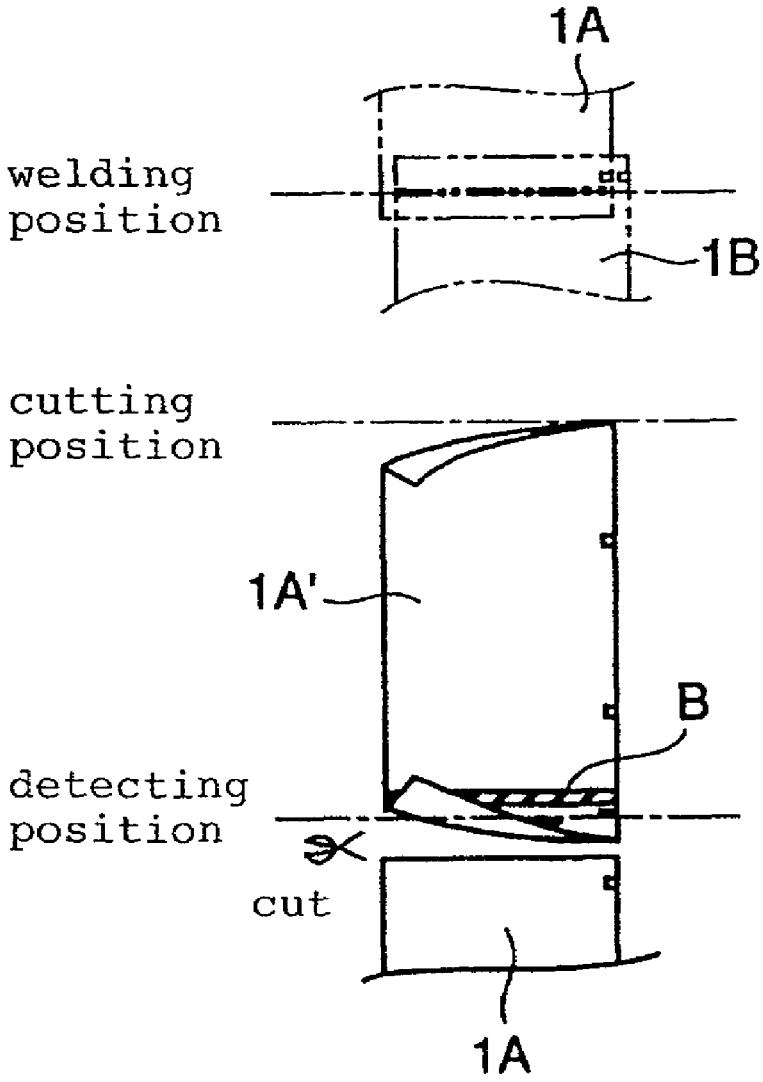
FIG. 11 is a view illustrative of a position for cutting a standby film.

The operation of film supply mechanism 10A thus constructed according to the present exemplary embodiment will be described below with reference to FIGS. 9 through 11.

FIG. 9A shows a first in-use posture of film supply mechanism 10A. In the first in-use posture, film rolls Ra, Rb are positioned at the same height, with film 1A being reeled out as a film in use from film roll Ra and film 1B from other film roll Rb being in a standby state. Film 1B has a beginning end held by clamp 73 (see FIG. 7) of joining mechanism 70. FIG. 10 shows states of films 1A, 1B. In FIG. 10, a "detecting position" refers to a position in which sensor 83 detects tape B, a "cutting position" refers to a position in which the film is cut by cutter 81, and a "fusing position" refers to a position in which the films are joined to each other by joining sealer 71.

When tape B applied to film 1A is detected by sensor 83 in the first in-use posture shown in FIG. 9A, the rollers 85 stop operating, thereby stopping feeding film 1A. In FIGS. 9A and 10A, there is a certain distance from the "detecting position" to tape B. This distance is illustrated as a displacement of the film which occurs after sensor 83 detects tape B until the film is stopped.

When the feeding of film 1A is stopped, cutter 81 is actuated in the position shown in FIG. 9A to cut film 1A. As shown in FIG. 10B, since tape B is positioned upstream of the "cutting position" with respect to the direction in which film 1A is fed, tape B is not included in the portion of film 1A which is positioned downstream of the "cutting position".

While in the posture shown in FIG. 9A, film 1A is further fed until the cut end of film 1A comes near the "welding position" as shown in FIG. 10C. Joining sealer 71 is actuated to join the end of film 1A and the beginning end of film 1B by thermal sealing. Reference numeral 3 in FIG. 10C denotes a thermal seal thus formed by the joining of the film ends. By thus feeding the cut film to a predetermined position and thereafter joining the films to each other, any overlapping film portion is reduced and hence any film waste is minimized.

When the joining of the film ends is finished, clamp 73 automatically releases film 1B, and two films 1A, 1B are reeled out toward the packaging mechanism. As shown in FIG. 9B, substantially at the same timing as the reeling out of the films, rotary support 88 starts rotating. FIG. 9B shows rotary support 88 as it has turned 45° clockwise from the position shown in FIG. 9A. At this time, film 1B has left guide roller 87, and is guided by roller 79. Tape B remains on the severed portion of film 1A.

Rotary support 88 is rotated while the films are being continuously reeled out. If rotary support 88 rotates too fast, then the film may possibly sag between film roll Rb and joining mechanism 70. Therefore, it is preferable to set the speed at which rotary support 88 rotates in view of such a problem.

FIG. 9C shows rotary support 88 having continuously turned 135° clockwise from the position shown in FIG. 9A. When rotary support 88 is rotated to the illustrated position, film 1B starts to be guided by guide rollers 86. Film 1A is dangling from film roll Ra.

Rotary support 88 is rotated until finally, as shown in FIG. 9D, film rolls Ra, Rb are positionally reversed 180° (a second in-use posture of film supply mechanism 10A). In the second in-use posture, film 1B from film roll Rb is consumed. In other words, film 1B is a film in use, and film 1A is a standby film.

The end of film 1A which has changed to a standby film-through the 180° reversal is set on joining mechanism 70 by the operator. As described above with reference to FIG. 7, the operator pulls down holding member 74 and sandwiches the end of the film between clamp 73 and bearing member 72. At this time, the film region to which tape B is applied is cut off and then the film is set in position, so that no tape B will be left on the standby film. Specifically, as shown in FIG. 11, film 1A' serving as the region including tape B is cut off from film 1A, so that tape B will not be left on remaining film 1A.

Figure 1B:
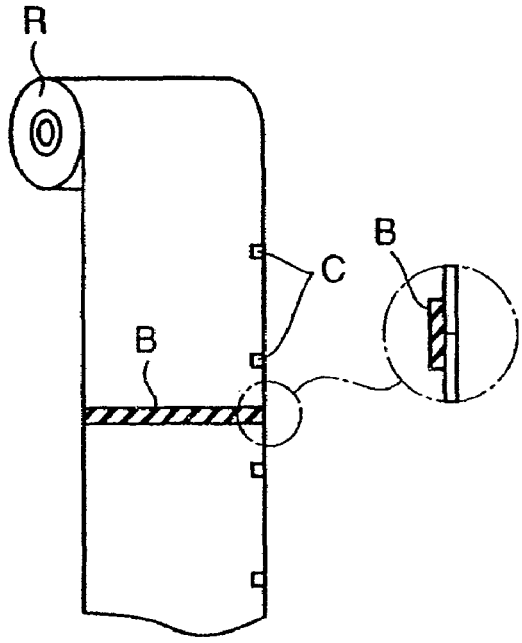
FIG. 1B is a view showing a tape applied to a seam joint between films.
Figure 2:
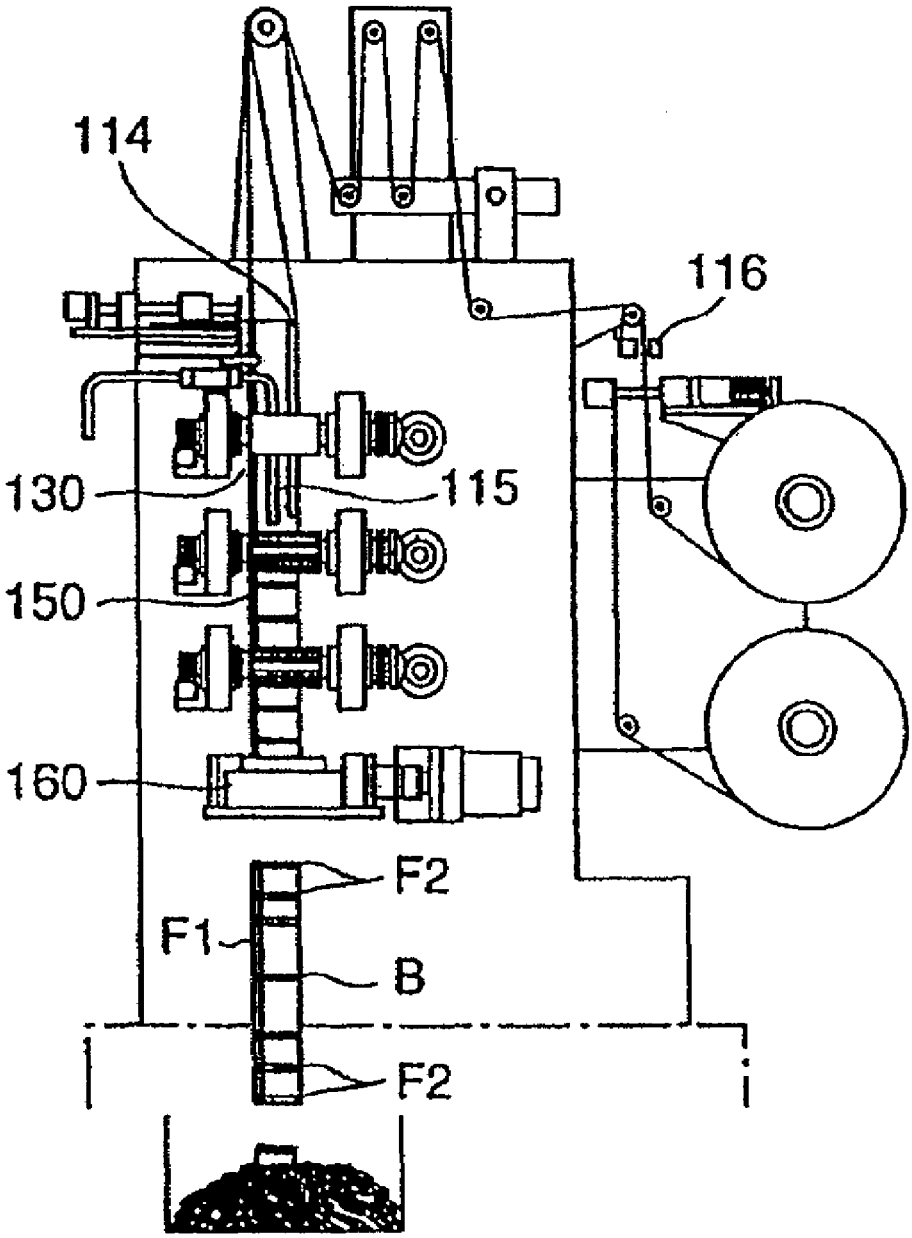
FIG. 2 is a view showing an example of a packaging apparatus according to the background art.

Subsequently, film 1B from film roll Rb is continuously used while in the state shown in FIG. 9D. When applied tape B is detected by sensor 83, the same operation as described above is carried out. In this manner, films 1A, 1B are joined to each other, and rotary support 88 is turned 180° again back to the state shown in FIG. 9A. The operation is repeated to consume film rolls Ra, Rb. When the film of a film roll is finished up, i.e., when sensor 83 detects end marks A (see FIG. 1) on the film, the film roll is brought into the left position as shown for replacement.

With the structure of film supply mechanism 10A according to the present exemplary embodiment, if a film roll is to be replaced in the right position as shown, then the film needs to be trained around the plurality of guide rollers 86. However, when a film roll is to be replaced in the left position as shown, the film only needs to be trained around one guide roller 87. Therefore, it is better in terms of operation efficiency to replace a film roll in the left position as shown. As with film 1B shown in FIG. 9, the newly set film is automatically trained around guide rollers 86, 87 as the mechanism is reversed 180°. Accordingly, when a film roll is replaced, it is not necessary for the operator to perform the tedious process of training the new film around guide rollers 86, 87.

With film supply mechanism 10A according to the present exemplary embodiment, as described above, film 1A from film roll Ra is continuously used (FIG. 9A), and when tape B is detected, the film is cut such that tape B is not included in a downstream film portion, and the cut film and the standby film are joined to each other. Therefore, tape B will not be delivered to packaging mechanism 10C. As a result, tape B will not be caught by the vertical sealing mechanism and the horizontal sealing mechanism of packaging mechanism 10C. Specifically, vertical sealing mechanism 30 or horizontal sealing mechanism 60 is reliably prevented from catching tape B, and hence tape B is prevented from being fused and partly applied to heater bars 31, 61, so that subsequently manufactured package bags will be prevented from being lowered in quality.

When films reeled out from respective two rolls are to be joined to each other, the standby position of film 1A and the standby position of film 1B are usually often different from each other. According to the present exemplary embodiment, however, film rolls Ra, Rb are positionally reversed 180°, and films 1A, 1B are drawn in opposite relationship in the first and second in-use postures. Therefore, films 1A, 1B can be set in the same standby position. Since the standby position is on the side of the standby film roll (Rb in FIG. 9) and is located above the film roll, the film can be easily set in position.

2nd Exemplary Embodiment

Figure 12:
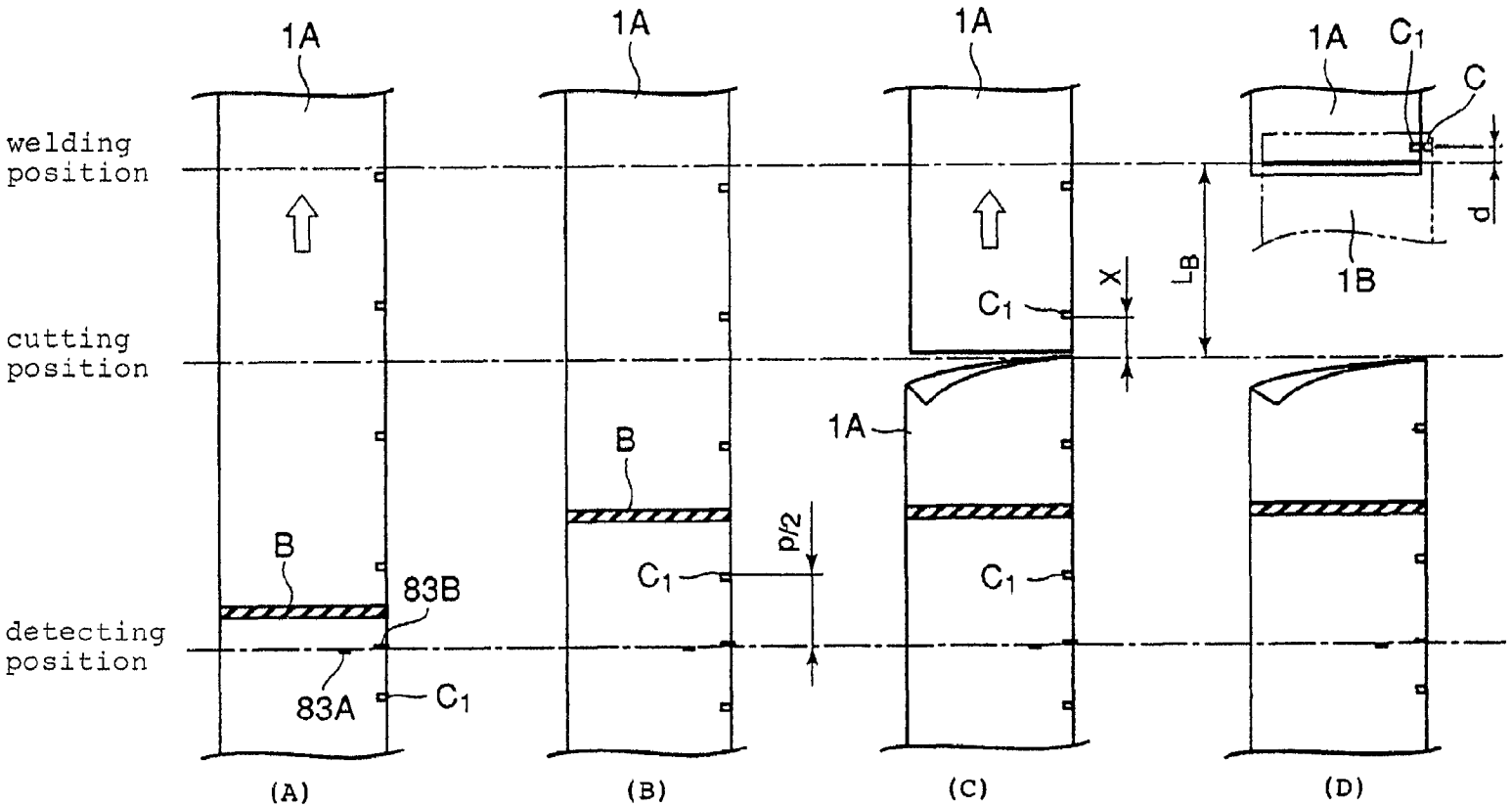
FIGS. 12A through 12D are views illustrative of the operation of a second exemplary embodiment.

Operation of film supply mechanism 10A in view of registration marks C applied to the films will be described below with reference to FIG. 12. When films 1A, 1B with registration marks C applied thereto are used, it is necessary to align the registration marks on films 1A, 1B. To meet such a requirement, film supply mechanism 10A operates according to the present exemplary embodiment as follows: In the present exemplary embodiment, as shown in FIG. 12, film supply mechanism 10A has sensor 83A for detecting tape B and sensor 83B for detecting registration marks C. The operation to be described below is carried out in the initial state shown in FIG. 9A. Subsequent operation (e.g., the reversal of film rolls Ra, Rb) is carried out in the same manner as described above, and will not be described below.

As shown in FIG. 12A, after sensor 83A detects tape B from film 1A in use, the film is continuously fed, and sensor 83B detects registration mark C, as shown in FIG. 12B. After sensor 83B detects registration mark C, film 1A is stopped when the distance between the "detecting position" and registration mark C is one-half of pitch p of registration marks C (half pitch p/2), for example.

Since a slight time usually elapses after registration mark C is detected until the film stops being fed, registration mark C is inevitably slightly spaced from the "detecting position". According to the present exemplary embodiment, the position where registration mark C is to be stopped is set to a location which is positioned a half pitch upstream of the "detecting position". In this manner, the accuracy with which to detect the position, where registration mark C is stopped, is increased.

Thereafter, as shown in FIG. 12C, while the film is being held at rest, cutter 81 is actuated to cut film 1A at the "cutting position".

Then, as shown in FIG. 12D, film 1A is further fed until the cut end of film 1A comes near the "fusing position". Since the position of registration mark C has been detected in the preceding step, it is possible to calculate the distance X between the "cutting position" and registration mark $C_1$ that is close thereto. Distance LB between the "cutting position" and the "fusing position" is predetermined. Therefore, in this step, film 1A may be supplied a distance which is calculated from distances X, $L_B$. In this manner, registration mark $C_1$ on film 1A and registration mark C on the standby film can be positionally aligned with each other.

Distance d from the "fusing position" to registration mark C as shown in FIG. 12D is determined based on the structure of joining mechanism 70 and the position where the operator applies the standby film. For positionally aligning registration marks $C_1$, C accurately with each other, any changes of distance d should preferably be held to a minimum. In order to minimize any changes of distance d, the upper surface of bearing member 72 for holding the film thereon should preferably be graduated for positioning registration mark C on the standby film, for example.

After registration mark $C_1$ on film 1A and registration mark C on standby film 1B have thus been positionally aligned with each other, the films are thermally sealed. The subsequent steps are carried out in the same manner as with the first exemplary embodiment.

With the above structure according to the second exemplary embodiment, the relative positional relationship between registration mark C and the "fusing position" can be grasped by detecting not only tape B but also registration mark C. Therefore, registration mark $C_1$ on film 1A and registration mark C on standby film 1B can be positionally aligned with each other by supplying cut film 1A by the preset distance.

3rd Exemplary Embodiment

Figure 13:
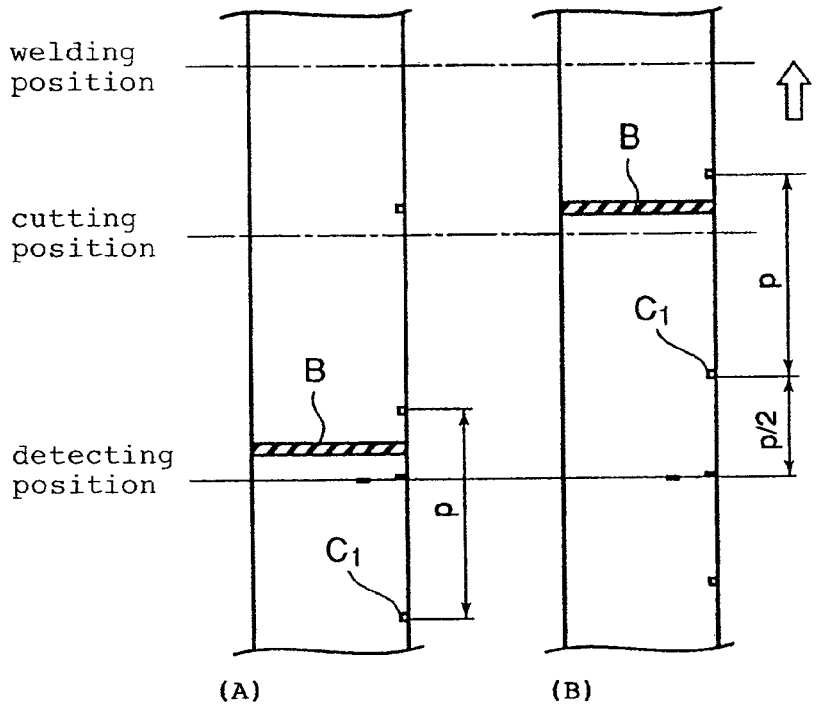
FIGS. 13A and 13B are views illustrative of a problem which arises when package bags of a relatively large size are manufactured.

The above operation according to the second exemplary embodiment may possibly suffer a drawback described below if a package bag has a relatively large size (if pitch p of registration marks is long). After tape B is detected and then next registration mark $C_1$ is detected, the film is provided until the distance between the "detecting position" and registration mark $C_1$ becomes p/2 (see FIG. 13B). At this time, tape B is positioned upstream of the "cutting position". When the film is cut at the "cutting position", tape B is included in an upstream film portion and, as a result, will be delivered to the packaging mechanism.

Figure 14:
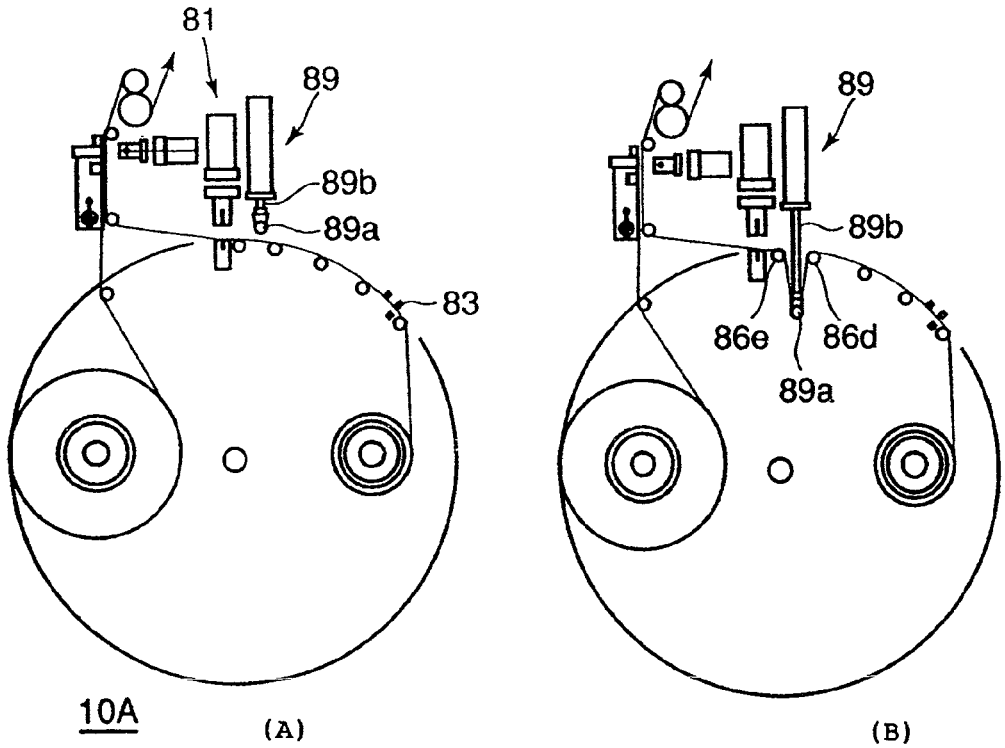
FIGS. 14A and 14B are front elevational views showing a structure of a film supply mechanism for addressing the problem shown in FIG. 13, FIG. 14A showing a guide roller of a distance adjusting mechanism which is in a retracted position, FIG. 14B showing the guide roller in an advanced position.

The above drawback is caused because there is no sufficient distance between the position of sensor 83 (detecting position) and the position of cutter 81 (cutting position). To prevent the above drawback from occurring, film supply mechanism 10A may be of a larger size to increase the distance between sensor 83 and cutter 81, for example. In this manner, the distance between the "detecting position" and the "cutting position" is increased, thus preventing the above drawback from occurring. However, such a solution makes the mechanism larger in size. The film supply mechanism according to the present exemplary embodiment includes distance adjusting device 89 shown in FIG. 14 for addressing the above problem without causing the mechanism to be larger in size.

Distance adjusting device 89 is disposed slightly upstream of cutter 81 with respect to the direction in which the film is supplied. Distance adjusting device 89 comprises an air cylinder having cylinder arm 89*b* and guide roller 89*a* rotatably mounted on the distal end of cylinder arm 89*b*. As shown in FIG. 14A, when cylinder arm 89*b* is retracted, guide roller 89*a* is spaced from the film. As shown in FIG. 14B, when cylinder arm 89*b* is advanced, guide roller 89*b* is moved inwardly of two guide rollers 86*d*, 86*e*.

When guide roller 89*b* is thus moved, the length of the film trained around guide rollers 86*d*, 86*e*, 89*a* is increased, resulting in an increase in the distance between the "detecting position" and the "cutting position". Accordingly, even when package bags of a relatively large size are produced, the problem that tape B is positioned upstream of the "cutting position", as described above with reference to FIG. 13, is prevented from happening. In addition, distance adjusting device 89 does not cause the mechanism to be larger in overall size.

While some exemplary embodiments of the present invention have been described above, the present invention is not limited to the above exemplary embodiments. In film supply mechanism 10A, film rolls Ra, Rb are positionally reversed 180° in the above exemplary embodiments. However, two film rolls Ra, Rb may be fixedly installed. Even if they are fixedly installed, sensor 83 detects tape B and the film is cut at a position that is spaced downstream of tape B with respect to the direction in which the film is fed, based on the detected result, so that tape B is prevented from remaining on a downstream film portion.

Figure 15:
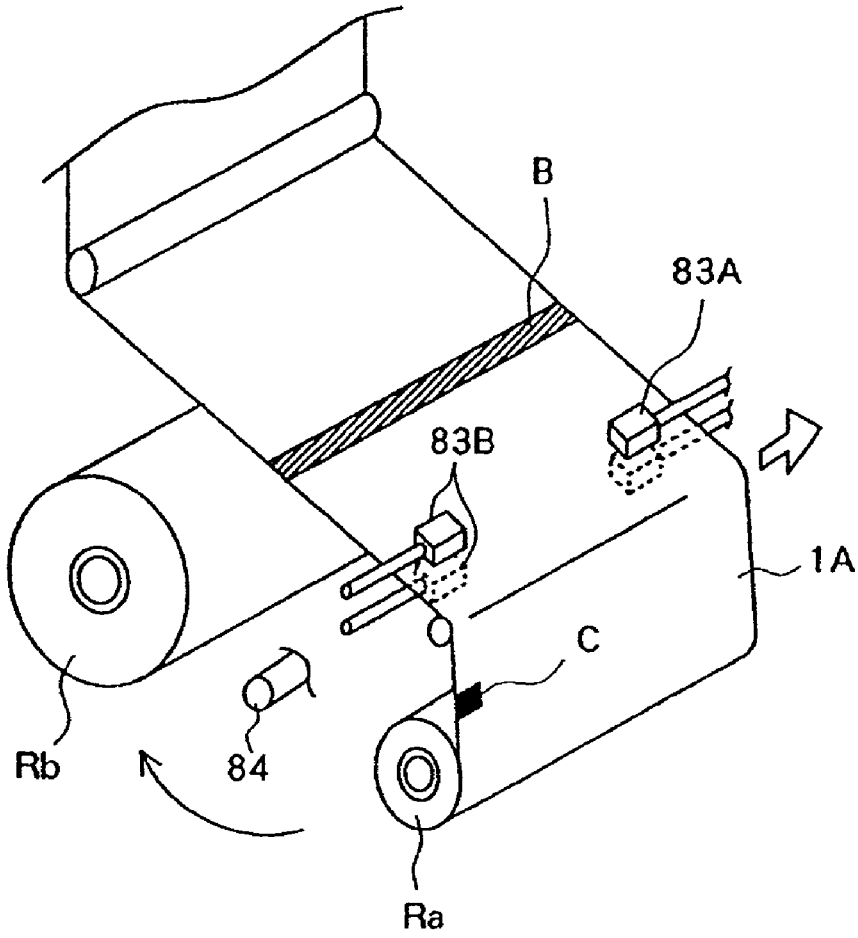

In the structure in which film supply mechanism 10A is reversed 180° according to the above exemplary embodiments, sensor 83 (see FIG. 6) may or may not rotate in unison with guide roller group 86 upon rotation of film rolls Ra, Rb. As shown in FIG. 15, each of sensor 83A (for detecting tape B) and sensor 83B (for detecting registration mark C) may move toward and away from the film. In normal operation, sensors 83A, 83B are held in their advanced positions for detecting the tape and the registration mark. When film rolls Ra, Rb are reversed 180°, sensors 83A, 83B are displaced to their retracted positions out of the way of film rolls Ra, Rb as they are reversed. After the reversing movement of film rolls Ra, Rb is finished, sensors 83A, 83B are brought into their advanced positions to resume normal operation. While sensor 83 is provided for each guide roller group in the arrangement shown in FIG. 6, it is not necessary to provide sensor 83 for each guide roller group in the arrangement shown in FIG. 15.

Packaging mechanism 10C may be of any of various other structures other than the structure shown in FIG. 3. For example, a packaging mechanism for applying a plug to package bag 91 (see FIG. 4) may be employed.

The invention claimed is:

1. A film supplying apparatus comprising:

a receiving member that holds the beginning end of a first or second film in a standby state;

a joining mechanism disposed near said receiving member, that joins said films to each other in a joining position;

a roller that reels in from a film roll at least one of said first and second films in use;

a sensor that detects a tape applied to a seam joint of said first and second films;

a cutter that cuts off a portion of said film in use which is disposed upstream of a joined region thereof, in a cutting position which is disposed downstream of said sensor with respect to the direction in which said film is fed;

a rotary support supporting two roll holding members on which said film rolls are rotatably mounted, said rotary support being rotatable about a support shaft to positionally reverse said film rolls through 180°;

a pair of a plurality of guide rollers disposed on a circumferential surface of said rotary support extending concentrically with a center of said support shaft in symmetrical position;

wherein said rotary support is selectively movable between a first in-use posture in which said first film is a film in use and in which said second film is a standby film and a second in-use posture which is reversed 180° from said first in-use posture and in which said first film is a standby film and said second film is a film in use, wherein said cutter cuts off a portion of said film in use which is disposed downstream of said tape, based on a detected result from said sensor;

said joining mechanism joins the cut end of said film in use and the end of said first or second film held in the standby state, to each other; and the guide rollers are located between said cutter and said sensor in the in-use posture.

2. The film supplying apparatus according to claim 1, wherein said roller feeds said film in use until the cut end of said film in use moves close to said joining position, and thereafter said joining mechanism joins said films to each other.

3. The film supplying apparatus according to claim 1, wherein said sensor is disposed for movement toward and away from said elongate film, and is disposed in a position retracted from said elongate film while said rotary support rotating to positionally reverse the film rolls though 180°.

4. The film supplying apparatus according to claim 3, wherein said rotary support is rotated to positionally reverse the film rolls though 180° after said films have been joined to each other by said joining mechanism.

5. The film supplying apparatus according to claim 4, wherein said receiving member is a constituent of a structural assembly disposed above the film roll serving as a standby roll, for allowing said first or second film to be set as a standby film therein each time said rotary support is rotated to positionally reverse the film rolls though 180°.

6. The film supplying apparatus according to claim 1, further comprising:

a movable guide roller disposed between said sensor and said cutter and movable to a predetermined position for increasing the length of said film extending from said sensor to said cutter.

7. The film supplying apparatus according to claim 6, wherein said movable guide roller is movable to said predetermined position between two adjacent guide rollers of said guide roller groups.

8. The film supplying apparatus according to claim 1, wherein said joining mechanism joins said films to each other by thermal sealing.

9. The film supplying apparatus according to claim 1, wherein said first and second films have a plurality of registration marks disposed at a predetermined pitch, said film supplying apparatus further comprising:

a registration mark detecting sensor for detecting said registration marks;

wherein said film roller stops feeding said film in use after said sensor detects said mark and said a registration mark detecting sensor detects a first one of said registration marks which is disposed downstream of said tape, and thereafter feeds said film in use again over a predetermined distance after said cutter cuts said film in use, for thereby positionally aligning the registration marks on said film in use and the registration marks on the other standby film with each other.

10. The packaging apparatus comprising:

a film supplying apparatus according to claim 1; and a packaging mechanism for shaping said elongate film supplied from said film supplying apparatus into a tubular form, vertically sealing the tubular form into a tubular film with a vertical sealing mechanism, horizontally sealing the tubular film with a horizontal sealing mechanism to produce a tubular film having a bottom, feeding a content into the tubular film, and thereafter horizontally sealing the tubular film again with said horizontal sealing mechanism to produce a package bag filled with said content.

* * * * *